US007641324B2

(12) United States Patent
Shimada

(10) Patent No.: US 7,641,324 B2
(45) Date of Patent: Jan. 5, 2010

(54) LIQUID-JET HEAD, METHOD OF MANUFACTURING THE SAME, AND LIQUID-JET APPARATUS

(75) Inventor: Masato Shimada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 480 days.

(21) Appl. No.: 11/475,129

(22) Filed: Jun. 27, 2006

(65) Prior Publication Data

US 2006/0290748 A1 Dec. 28, 2006

(30) Foreign Application Priority Data

Jun. 27, 2005 (JP) ..... 2005-187280

(51) Int. Cl.
*B41J 2/045* (2006.01)

(52) U.S. Cl. ..... 347/70

(58) Field of Classification Search ..... 347/68, 347/70–72; 310/311, 328
See application file for complete search history.

(56) References Cited

U.S. PATENT DOCUMENTS 6,378,996 B1 * 4/2002 Shimada et al. ..... 347/70

FOREIGN PATENT DOCUMENTS

JP 2000-246892 A 9/2000

* cited by examiner

*Primary Examiner*—An H Do
(74) *Attorney, Agent, or Firm*—Sughrue Mion, PLLC

(57) ABSTRACT

Provided are, a liquid-jet head capable of enhancing durability thereof when it is driven, and of making an arrangement density of piezoelectric elements high-density, a method of manufacturing the same, and a liquid-jet apparatus. The liquid-jet head includes: piezoelectric elements which are provided on a passage-forming substrate with a vibration plate interposed therebetween, and are respectively configured of a lower electrode, piezoelectric layers and upper electrodes, the passage-forming substrate having pressure generating chambers, which communicate with nozzle orifices for ejecting liquid droplets, formed therein, in which, while the lower electrode is continuously provided across plural piezoelectric elements, near-end portions of the lower electrode at least in regions of the lower electrode between adjacent ones of the piezoelectric elements are formed into thin-thickness portions thinner than portions of the lower electrode in other regions of the lower electrode.

12 Claims, 6 Drawing Sheets

LIQUID-JET HEAD, METHOD OF MANUFACTURING THE SAME, AND LIQUID-JET APPARATUS

The entire disclosure of Japanese Patent Application No. 2005-187280 filed Jun. 27, 2005 is expressly incorporated by reference herein.

BACKGROUND

1. Technical Field

The present invention relates to a liquid-jet head which ejects liquid from nozzle orifices, a method of manufacturing the same, and a liquid-jet apparatus. Particularly, the invention relates to: an ink-jet recording head, in which a part of pressure generating chambers communicating with nozzle orifices ejecting ink droplets is constructed of a vibration plate, piezoelectric elements are formed on a surface of this vibration plate, and displacement of the piezoelectric elements allows ink to be ejected; a method of manufacturing the same; and an ink-jet recording apparatus.

2. Related Art

As an inkjet recording head, in which a part of each of pressure generating chambers communicating with nozzle orifices ejecting ink droplets is constructed of a vibration plate, and this vibration plate is deformed by piezoelectric elements to apply pressure to ink in the pressure generating chambers, and thereby ink droplets are ejected from the nozzle orifices, two types have been put to practical use. One of these two types uses a piezoelectric actuator of a longitudinal vibration mode, which extends and contracts in an axial direction of a piezoelectric element. The other uses a piezoelectric actuator of a flexural vibration mode.

The former type is capable of changing a volume of each pressure generating chamber by having end faces of piezoelectric elements abut a vibration plate, and therefore can be manufactured as a head suitable for high-density printing. On the other hand, this type requires: a difficult process of cutting the piezoelectric elements into a comb-tooth shape while aligning the piezoelectric elements with arrangement pitches of the nozzle orifices; and an operation of positioning and fixing the cut piezoelectric elements with the pressure generating chambers. Accordingly, this type has a problem that a manufacturing process is complicated.

To the contrary, in the latter type, the piezoelectric elements can be built into the vibration plate by a relatively simple process where a green sheet of a piezoelectric material is attached to the vibration plate in accordance with a shape of the pressure generating chamber, and then baked. Nevertheless, a certain area is required for the use of flexure vibration, whereby this type has a problem that high-density arrangement is difficult.

Meanwhile, in order to eliminate the inconvenience of a recording head of the latter type, there has been proposed a recording head in which: a uniform piezoelectric material layer is formed on an entire surface of a vibration plate by use of a deposition technology; and by cutting this piezoelectric material layer into shapes corresponding to pressure generating chambers by use of a lithography method, piezoelectric elements are formed to be independent from one another in a manner respectively corresponding to the pressure generating chambers.

In the piezoelectric elements thus formed, a lower electrode is provided continuously across plural piezoelectric elements, and is set as a common electrode, and upper electrodes are set as individual electrodes of the respective piezoelectric elements. By selectively applying a voltage between this lower electrode and each of the upper electrodes, the desired piezoelectric elements are driven. Each of the piezoelectric elements thus formed assumes a structure where the piezoelectric layer and the upper electrode are provided so as to extend, in a longitudinal direction of that piezoelectric element, from that piezoelectric element to areas outside of regions facing the pressure generating chamber.

However, this recoding head has a problem that an electric discharge occurs between each of the upper electrodes and the lower electrode, and eventually causes dielectric breakdown of the piezoelectric layer, because electric field concentration occurs in end portions of the piezoelectric layers and the upper electrodes in a lead-out side thereof.

For this reason, there has been proposed a structure where narrow-width portions in the lower electrode, which are narrower than the other portions thereof, are formed so that dielectric breakdown of the piezoelectric layers is prevented by these narrow width portions (refer to, for example, JP-A-2000-246892 (pp. 5 to 6, FIGS. 5 to 6)).

In such a configuration where the narrow-width portion is thus formed in the lower electrode, the narrow-width portion has to be formed by patterning when the lower electrode is patterned, whereby pattern formation for this configuration is complicated. In addition, alignment of the narrow-width portion with the piezoelectric layer and the upper electrode is required, whereby, if an arrangement density of the piezoelectric elements becomes high-density, there arises a problem that the alignment is difficult.

Note that, obviously, the aforementioned problems exist not only with an ink-jet recording head, but also with other liquid-jet heads which eject liquid other than ink in like manner.

JP-A-2000-246892 (pp. 5 to 6, FIGS. 5 to 6) is an example of related art.

In consideration of the situation as described above, an object of the present invention is to provide: a liquid-jet head capable of enhancing durability thereof when it is driven, and making an arrangement density of piezoelectric elements high-density; a method of manufacturing the same; and a liquid-jet apparatus.

SUMMARY

A first aspect of the invention is a liquid-jet head characterized by including a piezoelectric element which is provided on a passage-forming substrate with a vibration plate interposed therebetween, and is respectively configured of a lower electrode, a piezoelectric layer and an upper electrode. In the passage-forming substrate, pressure generating chambers communicating with nozzle orifices for ejecting liquid droplets are formed. The liquid-jet head is also characterized in that, while the lower electrode is continuously provided across plural piezoelectric elements, near-end portions of the lower electrode at least in regions of the lower electrode between adjacent piezoelectric elements are formed into thin-thickness portions thinner than portions of the lower electrode in the other regions of the lower electrode.

According to the first aspect, by providing the thin-thickness portions in the lower electrode, electric field strength can be reduced in near-end portions of the plural piezoelectric elements, whereby amounts of distortion of piezoelectric elements can be reduced in these near-end portions in comparison to those in a central portion of the piezoelectric elements. As a result, durability of the liquid-jet head when it is driven can be enhanced.

A second aspect of the invention is the liquid-jet head according to the first aspect, characterized in that regions of the lower electrode corresponding to the piezoelectric elements, and central portions in the respective regions of the lower electrode between adjacent piezoelectric elements, which are the aforementioned other regions of the lower electrode, are formed in a uniform thickness.

According to the second aspect, while, patterning of the lower electrode can be easily carried out, film quality of the piezoelectric layer can be made uniform. Thereby, it becomes possible to provide the head having piezoelectric properties uniform among the piezoelectric elements, and as a result, being free from non-uniform ejection.

A third aspect of the invention is the liquid-jet head according to any one of the first and second aspects, characterized in that: widths of the lower electrode in regions thereof corresponding to the piezoelectric elements in a longitudinal direction of the respective piezoelectric elements are formed in a uniform width across the plural piezoelectric elements; and notch portions are provided in sections of the thin-thickness portions where the thin-thickness portions abut the piezoelectric elements, the notch portions making the thin-thickness portions discontinuous, in a direction in which the piezoelectric elements are provided in a line, from the regions of the lower electrode corresponding to the piezoelectric elements.

According to the third aspect, by providing the notch portions in the lower electrode, electric field strength can be further reduced in the near-end portions of the plural piezoelectric elements, whereby amounts of distortion of piezoelectric elements can be reduced in these near-end portions in comparison to those in the central portion of the piezoelectric elements. As a result, durability of the liquid-jet head when it is driven can be enhanced.

A fourth aspect of the invention is the liquid-jet head according to the third aspects, characterized in that the lower electrode in end portions of the piezoelectric elements in the longitudinal direction of the respective piezoelectric elements is formed in the same width as the piezoelectric layers between each of the adjacent the notch portions.

According to the fourth aspect, by forming the lower electrode in the piezoelectric elements in the same width as the piezoelectric layers, driving properties of the piezoelectric elements can be enhanced.

A fifth aspect of the invention is a liquid-jet apparatus characterized by including the liquid-jet head according to any one of the first to fourth aspects.

According to the fifth aspect, it is possible to realize the liquid-jet apparatus whose durability is enhanced.

A sixth aspect of the invention is a method of manufacturing a liquid-jet head, characterized by including the processes of: forming a lower electrode, which is configured to be common across a plurality of piezoelectric elements, by depositing and patterning the lower electrode on a passage-forming substrate with a vibration plate interposed therebetween; forming piezoelectric layers and upper electrodes entirely on a surface of the lower electrode; and forming the piezoelectric elements by applying dry-etching to the upper electrodes and the piezoelectric layers with respect to the respective pressure generating chambers, and forming, in the lower electrode, thin-thickness portions thinner than the other regions of the lower electrode by continuously applying the dry-etching to near-end portions of the lower electrode in regions between the piezoelectric elements, the piezoelectric elements being respectively configured of the upper electrodes, the respective piezoelectric layers and the lower electrode, and the dry-etching being performed by irradiating an ion beam to the upper electrodes and the piezoelectric layers from a direction tilted by a predetermined angle with respect to a direction orthogonal to an upper surface of the passage-forming substrate.

According to the sixth aspect, while the thin-thickness portions can be easily formed in the lower electrode, alignment of the thin-thickness portions with the piezoelectric layer and the upper electrode becomes unnecessary. Thereby, it becomes possible to make an arrangement density of piezoelectric elements high-density.

A seventh aspect of the invention is the method of manufacturing a liquid-jet head according to the sixth aspect, characterized in that, in the step of forming the thin-thickness portions, notch portions are provided in sections of the thin-thickness portions where the thin-thickness portions abut the piezoelectric elements, the notch portions making the thin-thickness portions discontinuous, in a direction in which the piezoelectric elements are provided in a line, form the regions of the lower electrode corresponding to the piezoelectric elements.

According to the seventh aspect, while the notch portions can be easily formed in the lower electrode, alignment of the notch portions with the piezoelectric layer and the upper electrode becomes unnecessary. Thereby, it becomes possible to make an arrangement density of piezoelectric elements high-density.

DESCRIPTION OF THE EXEMPLARY EMBODIMENTS

The present invention will be described in detail hereinbelow, based on embodiments.

Embodiment 1

Figure 1:
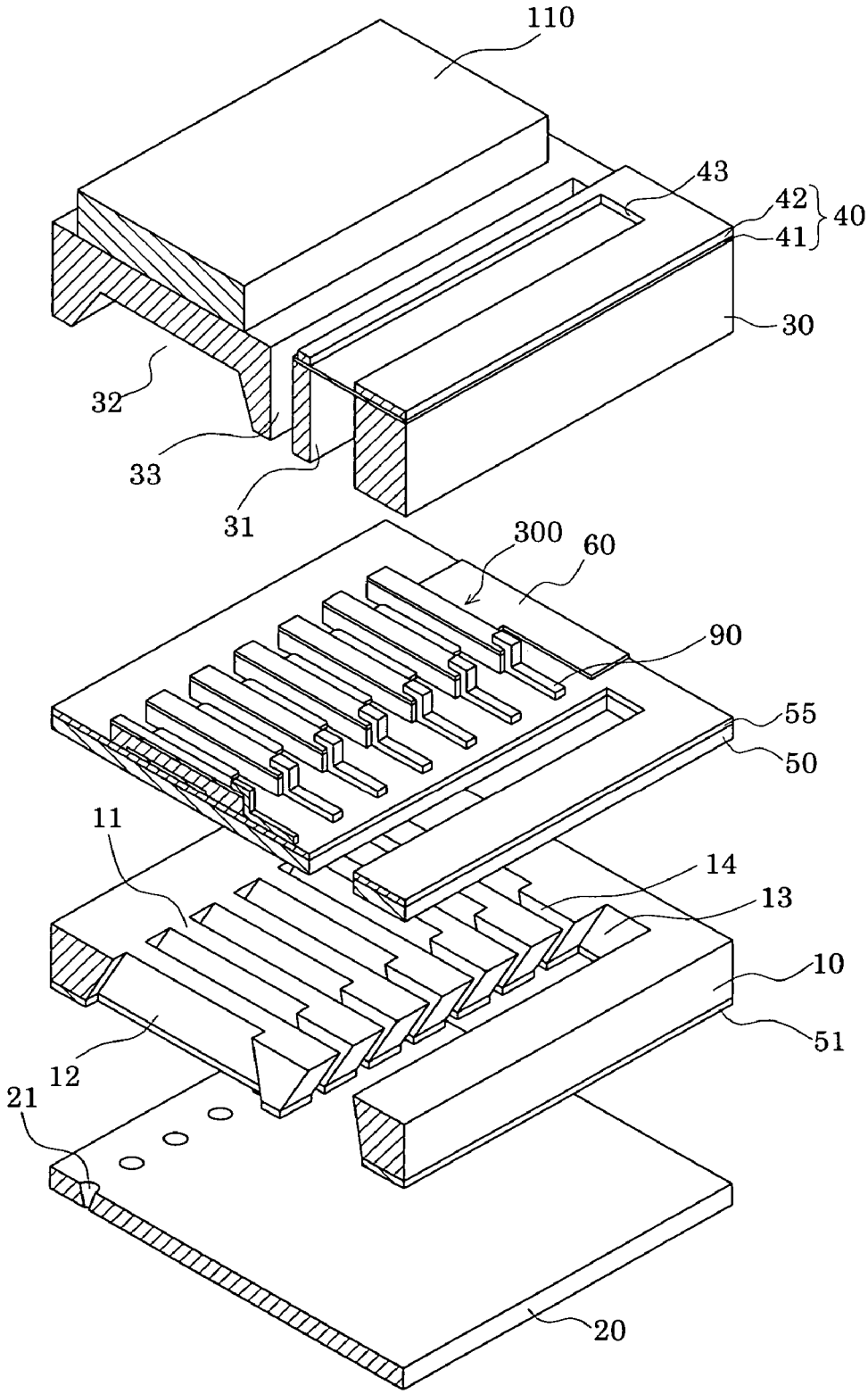
FIG. 1 is an exploded perspective view of a recoding head according to Embodiment 1 of the present invention.
Figure 2A:
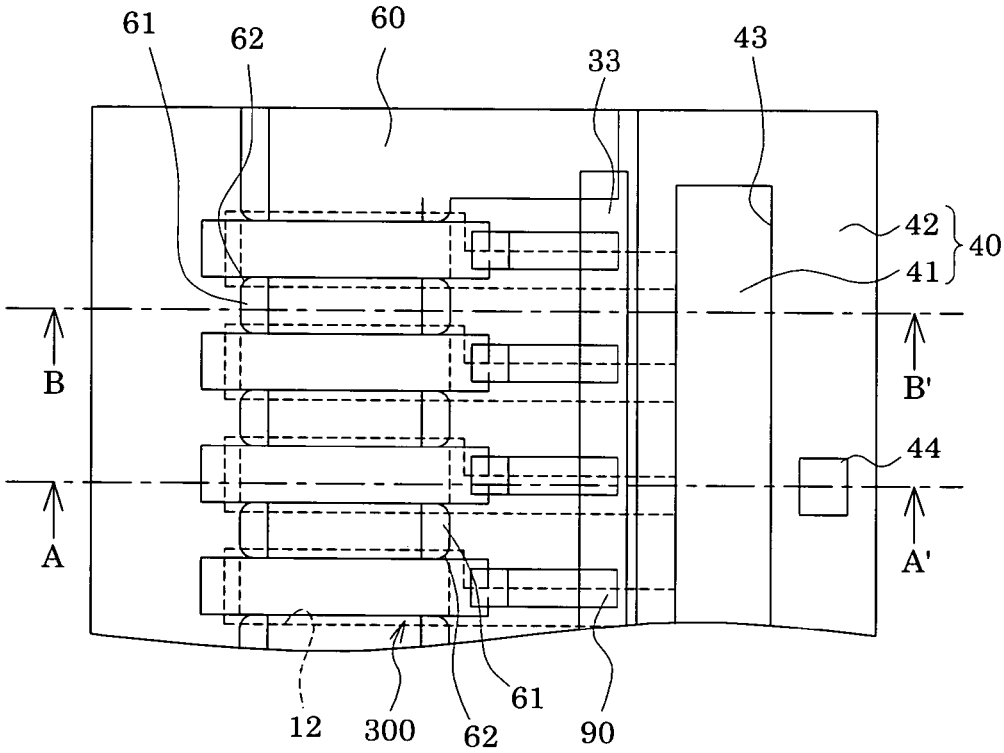
FIGS. 2A and 2B are plan views of main portions of the recoding head according to Embodiment 1 of the invention.
Figure 2B:
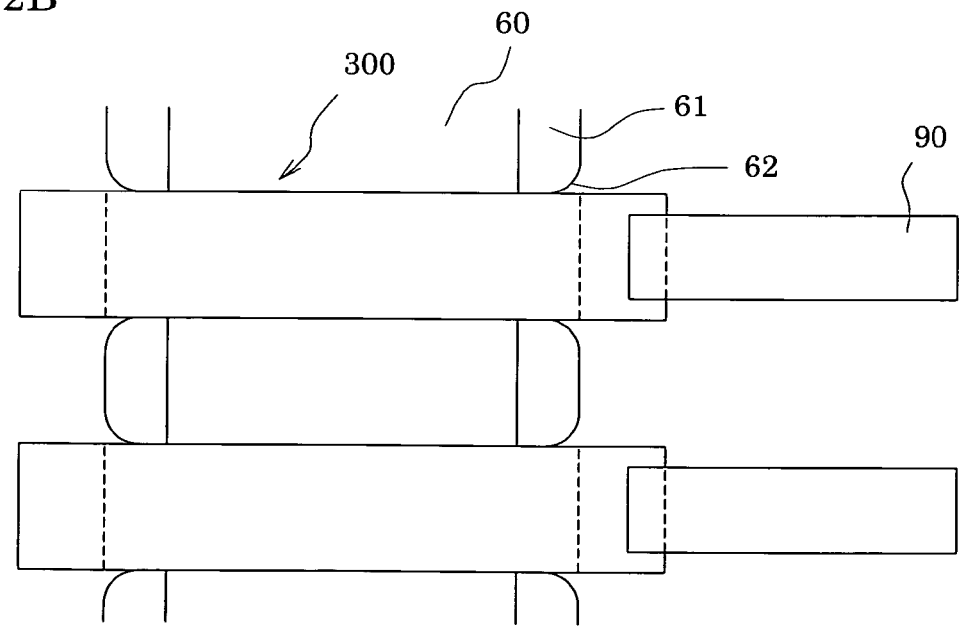
Figure 3A:
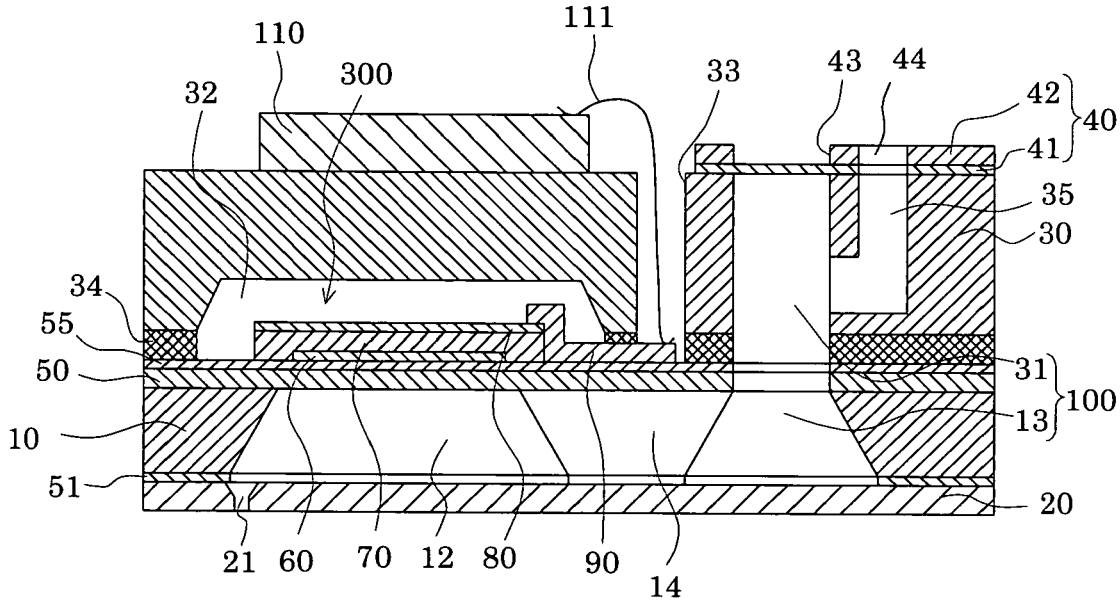
FIGS. 3A and 3B are cross-sectional views of the recoding head according to Embodiment 1 of the invention.
Figure 3B:
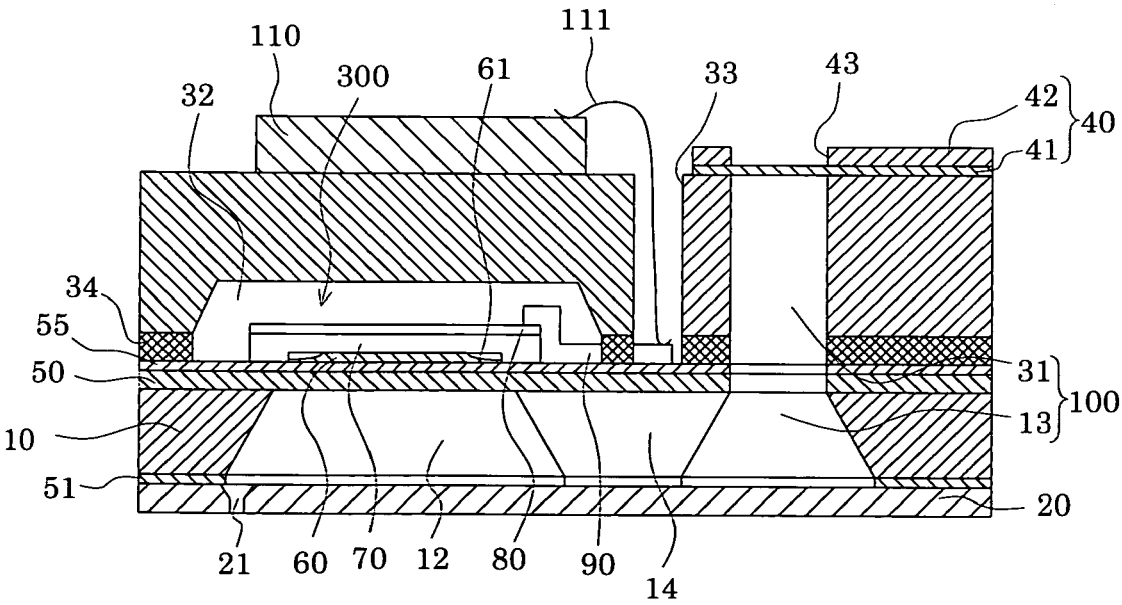

FIG. 1 is an exploded perspective view of an ink-jet recoding head according to Embodiment 1 of the invention, FIGS. 2A and 2B are plan views of main portions of the ink-jet recoding head, and FIGS. 3A and 3B are cross-sectional views taken along an A-A' line and a B-B' line, respectively, in FIG. 2A.

As illustrated, a passage-forming substrate 10 is made of a single crystal silicon substrate of the (110) plane orientation in this embodiment. On both upper and lower surfaces of the passage-forming substrate 10, there is formed an elastic film 50 in a 0.5 to 2 μm thickness made of silicon dioxide which has been previously formed by thermal oxidation.

In the passage-forming substrate 10, by applying anisotropic etching thereto from the other surfaces thereof, a plurality of pressure generating chambers 12 partitioned by a plurality of compartment walls 11 are provided so as to be arrayed in a line. Additionally, in the passage-forming substrate 10, a communicating portion 13, which composes a part of a reservoir 100 configured to be an ink chamber commonly used by the pressure generating chambers 12, is formed in an area outside the pressure generating chambers 12 in a longitudinal direction of the respective pressure generating chambers 12. The communication portion 13, and one end portion of each of the pressure generating chambers 12 in the longitudinal direction of the each pressure generating chamber 12 communicate with each other through an ink supply path 14 provided to the each pressure generating chamber 12. The ink supply path 14 maintains a path resistance against ink at a constant level, the ink flowing into the each pressure generating chamber 12 from the communicating portion 13.

In addition, a nozzle plate 20 is fixed, by use of an adhesive agent, a thermal adhesive film or the like, to an open surface of the passage-forming substrate 10 under a normal temperature, and with a protective film 51 interposed between the nozzle plate 20 and the passage-forming substrate 10, the protective film 51 having been used as a mask during formation of the pressure generating chambers 12. In the nozzle plate 20, there are perforated nozzle orifices 21, which communicate with the respective pressure generating chambers 12 in sides thereof opposite to the ink supply paths 14. Incidentally, the nozzle plate 20 is made of glass ceramic, stainless steel (SUS) or the like having a thickness of, for example, a 0.01 to 1.00 mm, and having a coefficient of linear expansion of, for example, 2.5 to 4.5 ($\times 10^{-6}$/°C.) at a temperature not higher than 300° C. The nozzle plate 20 also acts as a reinforcing plate protecting the single crystal silicon substrate against shocks and external forces thereto by entirely covering one surface of the passage-forming substrate 10 with one surface of the nozzle plate 20.

On the other hand, on a surface opposite to the opening surface of the passage-forming substrate 10, the elastic film 50 in a thickness, for example, of about 1.0 μm made of silicon dioxide is formed as described above. On this elastic film 50, an insulation film 55 in a thickness of, for example, about 0.4 μm made of zirconium oxide is formed. Additionally, on this insulation film 55, a lower electrode film 60, a piezoelectric layer 70, and an upper electrode film 80 are formed by lamination to collectively compose a piezoelectric element 300. The lower electrode film 60 is made of a combination of platinum and iridium, or the like, and has, for example, an about 0.2 μm thickness. The piezoelectric layer 70 is made of lead zirconate titanate (PZT) or the like, and has, for example, an about 1.0 μm thickness. The upper electrode film 80 is made of iridium or the like, and has, for example, a thickness of about 0.05 μm . Here, a piezoelectric element 300 means a part including the lower electrode film 60, the piezoelectric layer 70 and the upper electrode film 80. In general, each of the piezoelectric elements 300 is configured by using any one of the two electrodes as a common electrode, and by patterning the other of the two electrodes and the piezoelectric layer 70 for each of the pressure generating chambers 12. Additionally, a part, which is formed of the patterned one of the two electrodes and the piezoelectric layer 70, and causes piezoelectric strain due to an application of voltage to both of the electrodes, is termed as a piezoelectric active portion. In this embodiment, the lower electrode film 60 is configured as an electrode common to the plural piezoelectric elements 300 by continuously forming the lower electrode film 60 all across a region facing the respective pressure generating chambers 12. Additionally, the upper electrode films 80 are configured as individual electrodes for the respective piezoelectric elements 300 by providing the piezoelectric layers 70 and the upper electrode films 80 in a manner corresponding to the respective pressure generating chambers 12. Meanwhile, here, the piezoelectric elements 300 and a vibration plate where displacement occurs by driving the piezoelectric elements 300 are collectively termed as a piezoelectric actuator. Note that, in the above mentioned example, the elastic film 50, the insulation film 55 and the lower electrode film 60 collectively act as the vibration plate.

Here, the lower electrode film 60 in a longitudinal direction of the respective piezoelectric elements 300 is formed in a uniform width across the plurality of piezoelectric elements 300. End portions of the lower electrode film 60 are provided in regions facing the pressure generating chambers 12. In addition, the piezoelectric layers 70 and the upper electrode films 80 are provided so as to extend, in a longitudinal direction of the respective piezoelectric elements 300, to the outside of these end portions of the lower electrode film 60. End portions of the piezoelectric layers 70 and the upper electrode films 80 in one side in the longitudinal direction are extended to the outside of the pressure generating chambers 12, and a lead electrode 90, which is a lead wiring later in detail described, is provided on each of the end portions on the side where the piezoelectric layers 70 and the upper electrode films 80 are thus extended.

Additionally, as shown in FIGS. 2A, 2B, and 3B, near-end portions of the lower electrode film 60 at least in regions thereof between each of the adjacent piezoelectric elements 300 are formed into thin-thickness portions 61 having a thickness thinner than portions of the lower electrode film 60 in other regions thereof. In this embodiment, in addition to the regions of the lower electrode 60 between each of the adjacent piezoelectric elements 300, near-end portions of the lower electrode film 60 in both areas outside of the line of the piezoelectric elements 300 are also formed into the thin-thickness portions 61 having a thickness thinner than portions of the lower electrode film 60 in the other regions thereof. These thin-thickness portions 61 are formed in a thickness thinner than a thickness in central portions in the respective regions thereof between each of the adjacent piezoelectric elements 300 and the regions thereof corresponding to the piezoelectric elements 300, which are the aforementioned other regions of the lower electrode. The central portions of the lower electrode film 60 in the regions thereof between each of the adjacent piezoelectric elements 300 and the regions thereof corresponding to the piezoelectric elements 300 are formed in a uniform thickness. By adopting a configuration as described above, while patterning of the lower electrode can be easily carried out, film quality of the piezoelectric layer can be made uniform. Thereby, it becomes possible to provide the head having piezoelectric properties uniform among the piezoelectric elements, and as a result, being free from non-uniform ejection.

By thus having the near-end portions of the lower electrode film 60, which are located alongside end portions of the piezoelectric elements 300, formed into the thin-thickness portions 61, the following becomes possible: reduction in effective electric field strength in near-end portions of the plurality of piezoelectric elements 300; reduction in amounts of distortion of the piezoelectric elements 300 in the near-end portions thereof in comparison to those in the central portions thereof; and enhancement of durability of the head when it is driven. Incidentally, although the thin-thickness portions 61 may be provided in both or one of the end portions of the lower electrode film 60 in the longitudinal direction of the respective piezoelectric elements 300, it is preferable that the thin-thickness portions 61 be provided at least in one of the end portions of the lower electrode film 60 in a side thereof where the lead electrodes 90 are provided. This is because electric fields concentrate especially in the end portion of the piezoelectric layers 70 and the upper electrode films 80 in a side thereof corresponding to the lead electrodes 90. The electric field concentration brings about an electric discharge between the lower electrode film 60 and each of the upper electrode films 80, resulting in dielectric breakdown of piezoelectric layers 70. That is, the dielectric breakdown of piezoelectric layers 70 can be prevented if the thin-thickness portions 61 are provided least in one of the end portions of the lower electrode film 60 in the side thereof corresponding to the lead electrodes 90.

Additionally, in the thin-thickness portions 61 of the lower electrode film 60 in this embodiment, there are provided notch portions 62 in regions thereof abutting the respective piezoelectric elements 300 as shown in FIGS. 2A and 2B. By the notch portions 62, the thin-thickness portions 61 are made discontinuous, in a direction in which the piezoelectric elements 300 are arrayed in a line, from the lower electrode film 60 in the regions thereof corresponding to the piezoelectric elements 300. These notch portions 62 are provided in both sides of the respective thin-thickness portions 61 and along borders of the thin-thickness portions 61 with the piezoelectric elements 300, in a manner that the notch portions 62 have openings in the end portions of the lower electrode film 60. In addition, by providing the notch portions 62 in the lower electrode film 60, the lower electrode film 60 in the end portions of the piezoelectric elements 300 in the longitudinal direction of the respective piezoelectric elements 300 is formed in the same width as the piezoelectric layers 70.

The thus formed notch portions 62 allow the lower electrode film 60 in the regions thereof corresponding to the piezoelectric elements 300 to be discontinuous from the lower electrode film 60 between each of the adjacent piezoelectric elements 300 in the end portions of the lower electrode film 60, whereby the followings become possible: reduction in effective electric field strength in the near-end portions of the plurality of piezoelectric elements 300; to reduction in amounts of distortion of the piezoelectric elements 300 in the near-end portions thereof in comparison to those in the central region thereof; and further enhancement of durability of the head when it is driven.

To the upper electrode films 80 of the respective piezoelectric elements 300 as described above, the lead electrodes 90 made of, for example, gold (Au) or the like are respectively connected, and a voltage is selectively applied to the respective piezoelectric elements 300 through the lead electrodes 90.

On the passage-forming substrate 10 in which the above described piezoelectric elements 300 are formed, that is, on the lower electrode film 60, insulation film 55 and the lead electrodes 90, a protective plate 30 which has a reservoir portion 31 constituting at least a part of the reservoir 100 is joined by use of an adhesive agent 34. This reservoir portion 31 is, in this embodiment, formed so as to penetrate the protective plate 30 in a thickness direction thereof, and also to extend along the pressure generating chambers 12 in a width direction of the respective pressure generating chambers 12. The reservoir portion 31 is allowed to communicate with a communicating portion 13 of the passage-forming substrate 10 as described above, and thereby composes the reservoir 100 configured to be an ink chamber commonly used by the pressure generating chambers 12.

Additionally, in the protective plate 30, a piezoelectric element holding portion 32 having a space, which is large only to the extent not disturbing movements of the piezoelectric elements 300, is provided in a region facing the piezoelectric elements 300. This piezoelectric element holding portion 32 is formed in a size large enough to cover the plural piezoelectric elements 300 by itself, and the respective piezoelectric elements 300 are arranged inside this piezoelectric element holding portion 32. Thereby, the piezoelectric elements 300 are protected in a state where the piezoelectric elements 300 receive almost no influence from the external environment. The piezoelectric element holding portion 32 does not necessarily have to be sealed.

With regard to a material for the protective plate 30, it is preferable that a material having a thermal expansion coefficient substantially equal to that of the material of the passage-forming substrate 10, such as glass, a ceramic material or the like, be used. In this embodiment, the protective plate 30 is made of a single crystal silicon substrate which is the same material as the material of the passage-forming substrate 10.

Furthermore, in the protective plate 30, there is provided a through hole 33 penetrating the protective plate 30 in the thickness direction thereof. Near-end portions of the lead electrodes 90 lead out from the upper electrode films 80 of the respective piezoelectric elements 300 are provided so as to be exposed to the inside of the through hole 33.

In addition, a driver IC 110 for driving the piezoelectric elements 300 is fixed onto the protective plate 30. As the driver IC 110, for example, a circuit board, a semiconductor integrated circuit (IC) or the like can be used. The driver IC 110 and the near-end portions of each of the lead electrodes 90 exposed in the inside of the through hole 33 are electrically connected to each other through a connecting wiring 111 made of a conductive wire such as a bonding wire.

Moreover, a compliance plate 40 configured of a sealing film 41 and a fixing plate 42 is joined onto the protective plate 30. Here, the sealing film 41 is made of a flexible material with low rigidity (for example, a polyphenylene sulfide (PPS) film in a thickness of 6 μm), and a side of the reservoir portion 31 in one direction is sealed by the sealing film 41. In addition, the fixing plate 42 is made of a hard material such as a metal (for example, stainless steel (SUS) or the like in a thickness of 30 μm). In this fixing plate 42, an area facing the reservoir 100 is formed into an opening portion 43 obtained by completely removing the corresponding part of the fixing plate 42 in a thickness direction thereof. Accordingly, a side of the reservoir 100 in one direction is sealed by only the sealing film 41 having flexibility.

Moreover, on the compliance plate 40, an ink introducing port 44 for supplying ink to the reservoir 100 is formed in a region outside the reservoir 100, the region corresponding to a substantially central portion of the reservoir 100 in a longitudinal direction thereof. Furthermore, an ink introducing path 35 allowing the ink introducing port 44 and a sidewall of the reservoir 100 to communicate with each other is provided in the protective plate 30.

The ink-jet recoding head of this embodiment as described above takes in ink from unillustrated external ink supplying means through the ink introducing port 44, and fills with ink an inside of components thereof from the reservoirs 100 to the nozzle orifices 21. Then, the ink-jet recording head applies a voltage between the lower electrode film 60 and the upper electrode film 80 corresponding to each of the pressure generating chambers 12, in accordance with a recording signal from the driver circuit, and thereby allows the elastic film 50, the lower electrode film 60 and the piezoelectric layers 70 to undergo flexural deformation. Thus, a pressure in each of the pressure generating chambers 12 is increased, and the ink droplets are ejected from the nozzle orifices 21.

Here, a method of manufacturing the above described ink-jet recording head will be described in detail with reference to FIGS. 4A to 5C. Incidentally, FIGS. 4A to 5C are cross-sectional views showing manufacturing processes of the ink-jet recoding head.

Figure 4A:
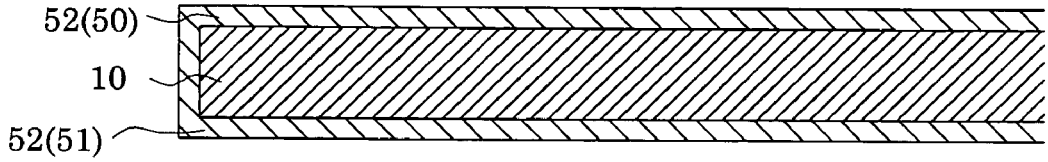
FIGS. 4A to 4E are views showing manufacturing processes of the recoding head according to Embodiment 1 of the invention.

As shown in FIG. 4A, first of all, the passage-forming substrate 10 made of a single silicon crystal substrate is thermally oxidized in a diffusion furnace at a temperature of approximately 1,100° C., whereby a silicon dioxide film 52, which becomes the elastic film 50 and a protective film 51, is formed on surfaces of the passage-forming substrate 10.

Figure 4B:
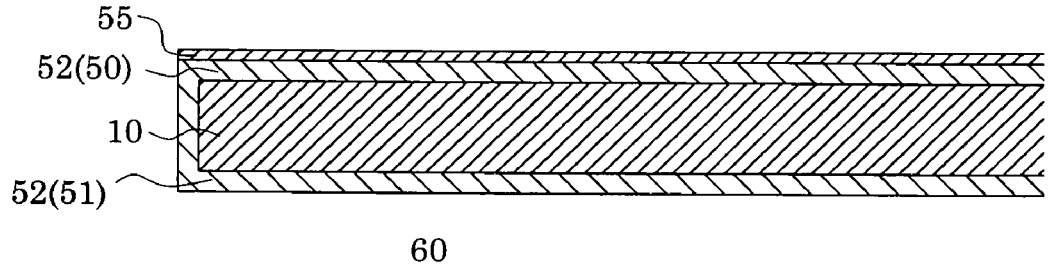

Subsequently, as shown in FIG. 4B, on the elastic film 50 (silicon dioxide film 52), an insulation film 55 made of zirconium oxide is formed. Specifically, the insulation film 55 made of zirconium oxide ($ZrO_2$) is formed by: forming a zirconium (Zr) layer on the elastic film 50 (silicon dioxide film 51) by use of a sputtering method or the like; and then thermally oxidizing this zirconium layer in a diffusion furnace at a temperature between 500 and 1200° C.

Figure 4C:
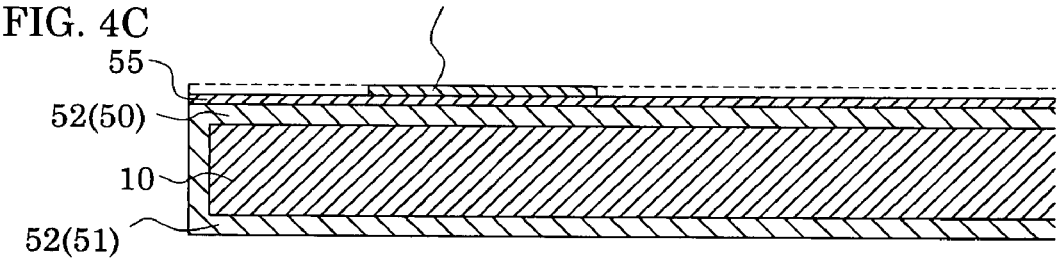

Then, as shown in FIG. 4C, the lower electrode film 60 is formed, for example, by laminating platinum and iridium on the insulation film 55, and thereafter, the lower electrode film 60 is patterned into a predetermined shape. The lower electrode film 60 is patterned so as to have the same width across the plurality of piezoelectric elements 300, and also to make the end portions of the lower electrode film 60 in the longitudinal direction of the respective piezoelectric elements 300 to be in regions facing the pressure generating chambers 12.

Figure 4D:
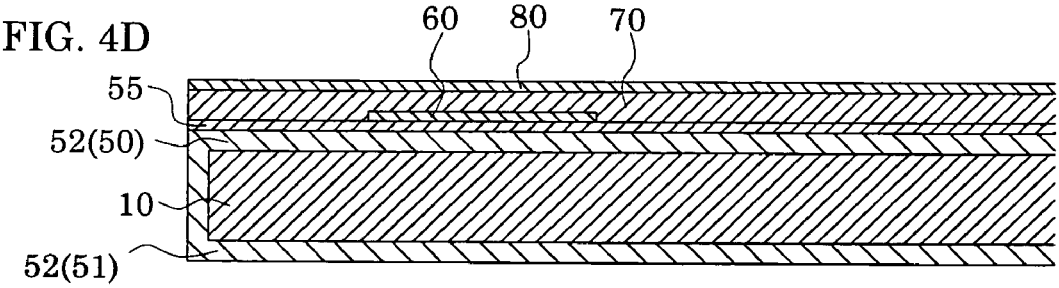

Thereafter, as shown in FIG. 4D, the piezoelectric layer 70 made of, for example, lead zirconate titanate (PZT) or the like, and the upper electrode film 80 made of, for example, iridium are formed on an entire surface of the passage-forming substrate 10.

A material for the piezoelectric layer 70 composing the piezoelectric elements 300 may be, for example, a ferroelectric-piezoelectric material such as lead zirconate titanate (PZT), or a relaxor ferroelectric material formed by adding metal such as niobium, nickel, magnesium, bismuth or yttrium to the ferroelectric-piezoelectric material. Additionally, although a method of forming the piezoelectric layer 70 is not particularly limited, the piezoelectric layer 70 is formed by use of what is called a sol-gel method in this embodiment. The sol-gel method is a method whereby the piezoelectric layer 70 made of a metallic oxide is obtained in a manner that: a metal organic compound is dissolved and dispersed into a solvent, and thereby what is called sol is obtained; thereafter, the sol is made into gel through application and drying of the sol; and the gel is baked at a high temperature.

Figure 4E:
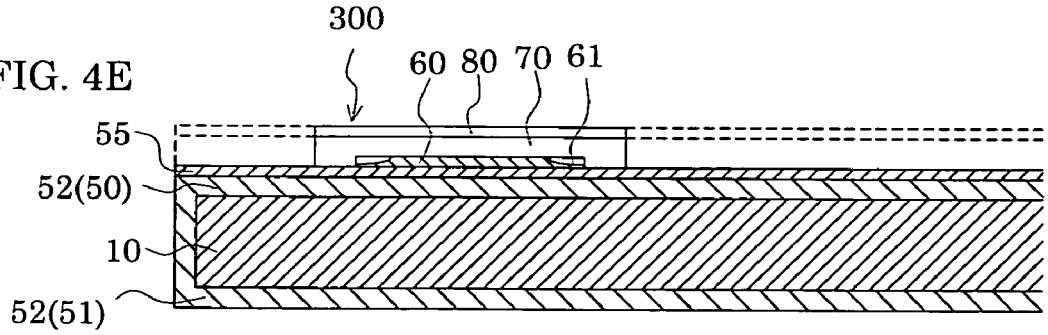

Then, as shown in FIG. 4E, the piezoelectric elements 300 are formed in regions facing the respective pressure generating chambers 12, by dry-etching the piezoelectric layer 70 and the upper electrode film 80.

In this embodiment, while the passage-forming substrate 10 is rotated, the dry-etching is carried out by irradiating an ion beam to dry-etch the piezoelectric layer 70 and the upper electrode film 80 from a direction tilted to an axis of the rotation. In this process, by continuously dry-etch near-end portions of the lower electrode film 60 in regions between the piezoelectric elements 300, the thin-thickness portions 61 thinner than the other region of the lower electrode film 60 are formed in the near-end portions of the lower electrode film 60 in the regions between the piezoelectric elements 300. That is, when an ion beam is irradiated from a direction tilted, for example, by an angle between 30 and 40 degrees to a direction orthogonal to an upper surface of the passage-forming substrate 10 while the passage-forming substrate 10 is rotated, the following occur. The lower electrode film 60 in the regions thereof covered with the piezoelectric layer 70 and the upper electrode film 80 and corresponding to the piezoelectric elements 300, and the lower electrode film 60 in central portions in the regions thereof between each of the adjacent piezoelectric elements 300 are not dry-etched, but surfaces of near-end portions of the lower electrode film 60 in the regions thereof between each of the adjacent piezoelectric elements 300 are dry-etched. Thereby, the thin-thickness portions 61 are formed in the end portions of the lower electrode film 60 in the regions between each of the adjacent piezoelectric elements 300.

By thus continuously dry-etching the near-end portions of the lower electrode film 60 when the piezoelectric layer 70 and the upper electrode film 80 are dry-etched, the thin-thickness portions 61 can be easily formed, and at the same time, alignment of the thin-thickness portions 61 with the piezoelectric layer 70 and the upper electrode film 80 becomes unnecessary. Accordingly, it becomes possible to make an arrangement density of the piezoelectric elements 300 high-density.

Additionally, in this embodiment, by continuously dry-etching the near-end portions of the lower electrode film 60, the notch portions 62 are formed in sections of the thin-thickness portions 61, the sections abutting the piezoelectric elements 300 as shown in FIG. 2B. By the notch portions 62, the thin-thickness portions 61 are made discontinuous, in a direction in which the piezoelectric elements 300 are arrayed in a line, from the regions of the lower electrode 60 corresponding to the piezoelectric elements 300. These notch portions 62 are formed by continuously carrying out the dry-etching when the thin-thickness portions 61 are formed by dry-etching. Thereby, the notch portions 62 are formed along side surfaces of the end portions of the piezoelectric elements 300, and a width of the lower electrode film 60 in the end portions of the piezoelectric elements 300 can be formed in the same width as a width of the piezoelectric layer 70.

Thus, by the dry-etching carried out when the piezoelectric elements 300 are formed, the notch portions 62 can be easily formed, and at the same time, alignment of the notch portions 62 with the piezoelectric layers 70 and the upper electrode films 80 becomes unnecessary. Accordingly, it becomes possible to make an arrangement density of the piezoelectric elements 300 high-density.

Figure 5A:
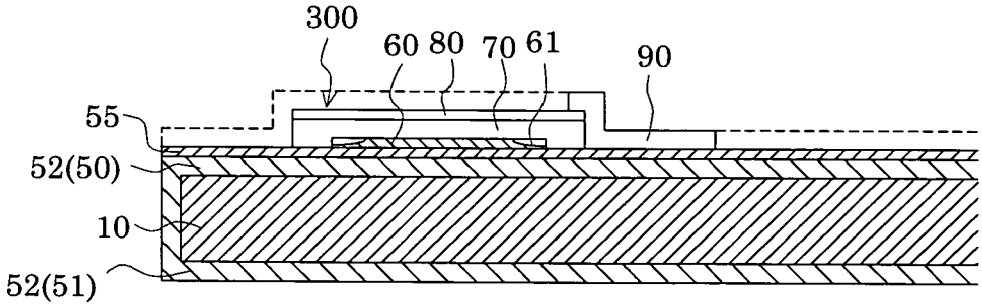
FIGS. 5A to 5C are views showing manufacturing processes of the recoding head according to Embodiment 1 of the invention.

Next, as shown in FIG. 5A, after the lead electrodes 90 made of, for example, gold (Au) or the like are deposited on the entire surface of the passage-forming substrate 10, the lead electrodes 90 are formed by patterning the lead electrodes 90 with respect to the respective piezoelectric elements 300 through an unillustrated mask pattern made of a resist or the like.

Figure 5B:
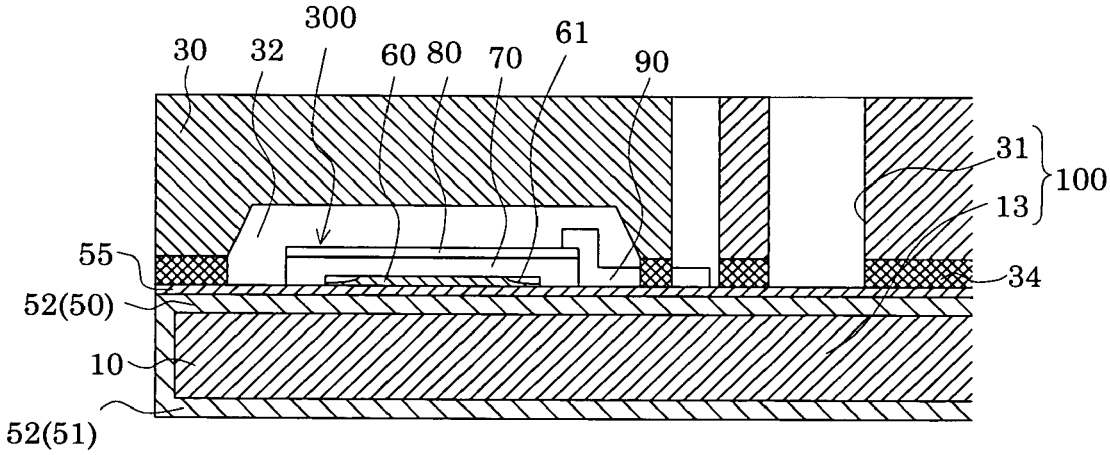

Thereafter, as shown in FIG. 5B, the protective plate 30, in which the reservoir portion 31 and the piezoelectric element holding portion 32 have been previously formed, is joined onto the passage-forming substrate 10 by use of the adhesive agent 34.

Figure 5C:
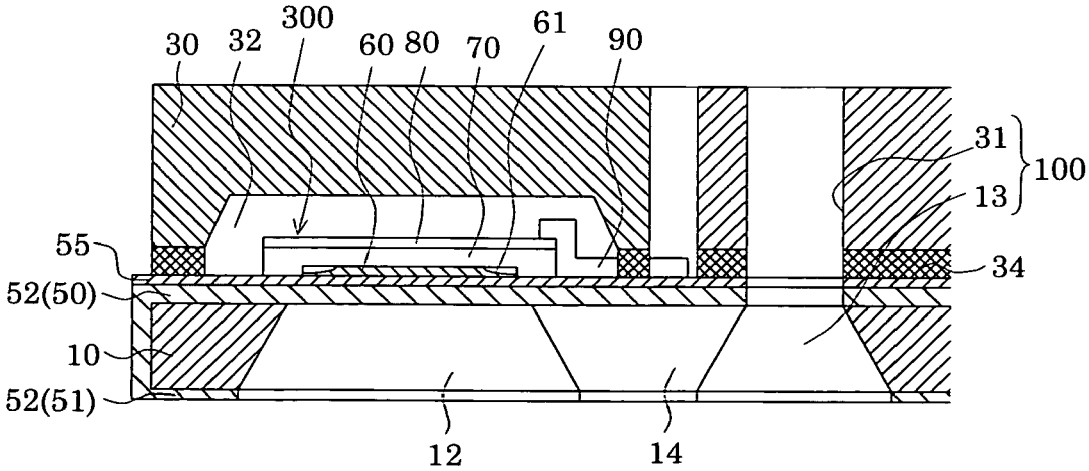

Subsequently, as shown in FIG. 5C, the protective film 51 is formed by patterning, into a predetermined shape, the silicon dioxide film 52 provided on a surface of the passage-forming substrate 10 opposite the surface on which the piezoelectric elements 300 are formed. Then, the pressure generating chambers 12, the communicating portion 13, the ink supply paths 14 and the like are formed in the passage-forming substrate 10 by applying anisotropic-etching (wet-etching) which uses an alkaline solution such as KOH, to the passage-forming substrate 10 with the protective film 51 used as a mask.

Thereafter, while the nozzle plate 20 perforated with the nozzle orifices 21 are joined to a surface of the passage-forming substrate 10 opposite the surface to which the protective plate 30 is joined, the compliance plate 40 is joined to the protective plate 30. Thereby, the ink-jet recording head as shown in FIG. 1 is formed.

Incidentally, in reality, a large number of chips are simultaneously formed on a single wafer by the aforementioned series of film formation and anisotropic-etching, and after these processes, the inkjet recording head is formed by dividing the single wafer into the passage-forming substrates 10 each having one chip size as shown in FIG. 1.

Other Embodiments

While the embodiment of the present invention has been described hereinabove, a basic configuration of the ink-jet recording apparatus is not limited to the aforementioned embodiment. For example, although Embodiment 1 described above assumes a configuration where the width of the lower electrode film 60 in the longitudinal direction of the respective piezoelectric elements 300 is provided in the regions facing the pressure generating chambers 12, the invention is not particularly limited to this configuration. The width of the lower electrode film 60 may be extended outside the pressure generating chambers 12. Even in this case, by forming the thin-thickness portions 61 in the lower electrode 60, the following become possible: reduction in effective electric field strength in the near-end portions of the plurality of piezoelectric elements 300; reduction in amounts of distortion of the piezoelectric elements 300 in the near-end portions thereof in comparison to those in the central region thereof; and enhancement of durability of the head when it is driven.

Additionally, for example, although Embodiment 1 described above assumes a configuration where the piezoelectric element holding portion 32 is provided in the protective plate 30 and the piezoelectric elements 300 is formed inside this piezoelectric element holding portion 32, the present invention is not particularly limited to this configuration. The piezoelectric element holding portion 32 does not have to be provided in the protective plate 30. In this case, it is only necessary to prevent destruction of the piezoelectric layers 70 due to moisture (humidity) by covering surfaces of the piezoelectric elements 300 with a protective film made of an inorganic material such as alumina. Obviously, the piezoelectric elements 300 covered with the protective film may be provided inside the piezoelectric element holding portion 32.

Figure 6:
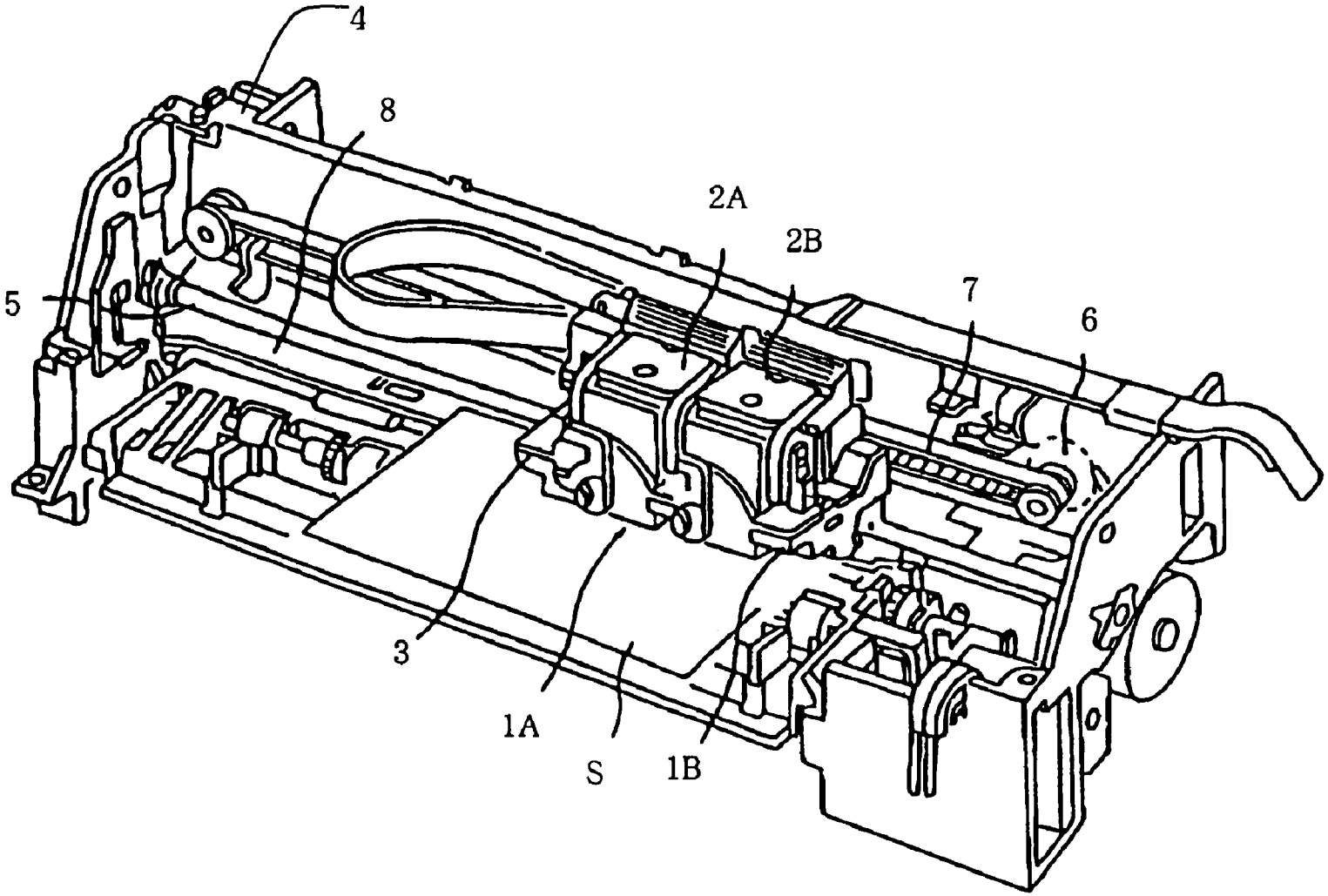
FIG. 6 is a schematic view of a recoding apparatus according to one embodiment of the invention.

Moreover, the thus configured ink-jet recording head composes a part of a recording head unit provided with an ink passage communicating with an ink cartridge and the like, and is thereby mounted on an ink-jet recording apparatus. FIG. 6 is a schematic view showing an example of the ink-jet recoding apparatus. As shown in FIG. 6, cartridges 2A and 2B, which compose ink supply means, are attachably and detachably provided respectively to ink-jet recording head units 1A and 2A each including the ink-jet recording head. Additionally, a carriage 3 having the recording head units 1A and 1B mounted thereon is provided to a carriage shaft 5 fixed to an apparatus body 4, in a state freely movable along an axial direction of the carriage shaft 5. These recording head units 1A and 1B are configured to be, for example, those which eject a black ink composition and a color ink composition, respectively.

Therein, a driving force of a drive motor 6 is transmitted to the carriage 3 through an unillustrated plurality of gears and a timing belt 7, whereby the carriage 3 having the recording head units 1A and 1B mounted thereon is moved along the carriage shaft 5. On the other hand, a platen 8 is provided along the carriage shaft 5 in the apparatus body 4, and a recording sheet S, which is a recording medium such as paper fed by an unillustrated feed roller or the like, is conveyed on the platen 8.

Incidentally, although the above embodiment has been described by taking the ink-jet recording head as an example of a liquid-jet head, the present invention is broadly intended for liquid-jet heads in general. Therefore, it is obviously possible to apply the invention to a liquid-jet head which ejects liquid other than ink. As liquid jet heads which eject liquid other than ink, for example, the following can be listed: various recording heads used for image recording apparatuses such as a printer; a color material jet head used for manufacturing color filters of a liquid crystal display and the like; an electrode material jet head used for forming electrodes of an organic EL display, a field emission display (FED) and the like; a bio-organic matter jet head used for manufacturing biochips; and the like.

What is claimed is:

1. A liquid-jet head comprising:

piezoelectric elements which are provided on a passage-forming substrate with a vibration plate interposed therebetween, and are respectively configured of a lower electrode, piezoelectric layers and upper electrodes, the passage-forming substrate having pressure generating chambers, which communicate with nozzle orifices for ejecting liquid droplets, formed therein, wherein, while the lower electrode is continuously provided across plural piezoelectric elements, near-end portions of the lower electrode at least in regions of the lower electrode between adjacent piezoelectric elements are formed into thin-thickness portions thinner than portions of the lower electrode in other regions of the lower electrode.

2. The liquid-jet head according to claim 1, wherein regions of the lower electrode corresponding to the piezoelectric elements, and central portions in the respective regions of the lower electrode between adjacent piezoelectric elements, which are the aforementioned other regions of the lower electrode, are formed in a uniform thickness.

3. The liquid-jet head according to claim 1, wherein: widths of the lower electrode in regions thereof corresponding to the piezoelectric elements in a longitudinal direction of the respective piezoelectric elements are formed in a uniform width across the plural piezoelectric elements; and notch portions are provided in sections of the thin-thickness portions where the thin-thickness portions abut the piezoelectric elements, the notch portions making the thin-thickness portions discontinuous, in a direction in which the piezoelectric elements are provided in a line, from the regions of the lower electrode corresponding to the piezoelectric elements.

4. The liquid-jet head according to claim 2, wherein: widths of the lower electrode in regions thereof corresponding to the piezoelectric elements in a longitudinal direction of the respective piezoelectric elements are formed in a uniform width across the plural piezoelectric elements; and notch portions are provided in sections of the thin-thickness portions where the thin-thickness portions abut the piezoelectric elements, the notch portions making the thin-thickness portions discontinuous, in a direction in which the piezoelectric elements are provided in a line, from the regions of the lower electrode corresponding to the piezoelectric elements.

5. The liquid-jet head according to claim 3, wherein the lower electrode in end portions of the piezoelectric elements in the longitudinal direction of the respective piezoelectric elements is formed in the same width as that of the piezoelectric layers between each of the adjacent notch portions.

6. The liquid-jet head according to claim 4, wherein the lower electrode in end portions of the piezoelectric elements in the longitudinal direction of the respective piezoelectric elements is formed in the same width as that of the piezoelectric layers between each of the adjacent notch portions.

7. A liquid-jet apparatus comprising the liquid-jet head according to claim 1.

8. A liquid-jet apparatus comprising the liquid-jet head according to claim 2.

9. A liquid-jet apparatus comprising the liquid-jet head according to claim 3.

10. A liquid-jet apparatus comprising the liquid-jet head according to claim 4.

11. A liquid-jet apparatus comprising the liquid-jet head according to claim 5.

12. A liquid-jet apparatus comprising the liquid-jet head according to claim 6.

* * * * *

UNITED STATES PATENT AND TRADEMARK OFFICE

CERTIFICATE OF CORRECTION

PATENT NO. : 7,641,324 B2
APPLICATION NO. : 11/475129
DATED : January 5, 2010
INVENTOR(S) : Masato Shimada It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 672 days.

Signed and Sealed this

Sixteenth Day of November, 2010

David J. Kappos

David J. Kappos
*Director of the United States Patent and Trademark Office*